US006051531A

United States Patent [19]

Noonan et al.

[11] Patent Number: 6,051,531

[45] Date of Patent: Apr. 18, 2000

[54] POLYMERIC ABSORBER FOR LASER-COLORANT TRANSFER

[75] Inventors: John M. Noonan, Rochester; Mitchell Burberry; Douglas R. Robello, both of Webster, all of N.Y.

[73] Assignee: Eastman Kodak Company, Rochester, N.Y.

[21] Appl. No.: 09/192,769

[22] Filed: Nov. 16, 1998

[51] Int. Cl.[7] ..... B41M 5/035; B41M 5/38

[52] U.S. Cl. ..... 503/227; 428/195; 428/913; 428/914; 430/945

[58] Field of Search ..... 8/471; 428/195, 428/913, 914; 430/945; 503/227

[56] References Cited

U.S. PATENT DOCUMENTS

| | | | |
|---|---|---|---|
| 4,924,141 | 5/1990 | DeBoer et al. | 503/277 |
| 5,667,860 | 9/1997 | Burns et al. | 428/64.1 |

*Primary Examiner*—Bruce H. Hess
*Attorney, Agent, or Firm*—Harold E. Cole

[57] ABSTRACT

A colorant-donor element for thermal colorant transfer comprising a support having thereon a colorant layer having a laser radiation-absorbing material associated therewith, and wherein the laser radiation-absorbing material comprises an ionic polymer having a certain charge having associated therewith an ionic dye of opposite charge, the ionic dye comprising a laser radiation-absorbing chromophore comprising an organic moiety having a plurality of conjugated double bonds and an optical absorption of from about 400 to about 1200 nm.

20 Claims, No Drawings

POLYMERIC ABSORBER FOR LASER-COLORANT TRANSFER

CROSS REFERENCE TO RELATED APPLICATION

Reference is made to commonly-assigned copending U.S. patent application Ser. No. 09/193,342, filed of even date herewith, entitled Polymeric Absorber For Laser-Colorant Transfer by Burberry et al., the teachings of which are incorporated herein by reference.

FIELD OF THE INVENTION

This invention relates to an ionic polymeric absorber used in laser-colorant transfer donor elements. In particular, the ionic polymeric absorber is useful in laser colorant-transfer systems designed for digital color halftone proofing.

BACKGROUND OF THE INVENTION

In order to approximate the appearance of continuous-tone (photographic) images via ink-on-paper printing, the commercial printing industry relies on a process known as halftone printing. In halftone printing, color density gradations are produced by printing patterns of dots or areas of varying sizes, but of the same color density, instead of varying the color density continuously as is done in photographic printing.

There is an important commercial need to obtain a color proof image before a printing press run is made. It is desired that the color proof will accurately represent at least the details and color tone scale of the prints obtained on the printing press. In many cases, it is also desirable that the color proof accurately represent the image quality and halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled.

Colorants that are used in the printing industry are insoluble pigments. By virtue of their pigment character, the spectrophotometric curves of the printing inks are often unusually sharp on either the bathochromic or hypsochromic side. This can cause problems in color proofing systems in which colorants, as opposed to pigments, are being used. It is very difficult to match the hue of a given ink using a single colorant.

In U.S. Pat. No. 5,126,760, a process is described for producing a direct digital, halftone color proof of an original image on a colorant-receiving element. The proof can then be used to represent a printed color image obtained from a printing press. The process described therein comprises:

a) generating a set of electrical signals which is representative of the shape and color scale of an original image;

b) contacting a colorant-donor element comprising a support having thereon a colorant layer and an infrared-absorbing material with a first colorant-receiving element comprising a support having thereon a polymeric, colorant image-receiving layer;

c) using the signals to imagewise-heat by means of a diode laser the colorant-donor element, thereby transferring a colorant image to the first colorant-receiving element; and d) retransferring the colorant image to a second colorant image-receiving element which has the same substrate as the printed color image.

In the above process, multiple colorant-donors are used to obtain a complete range of colors in the proof. For example, for a full-color proof, four colors: cyan, magenta, yellow and black are normally used.

By using the above process, the image colorant is transferred by heating the colorant-donor containing the infrared-absorbing material with the diode laser to volatilize the colorant, the diode laser beam being modulated by the set of signals which is representative of the shape and color of the original image, so that the colorant is heated to cause volatilization only in those areas in which its presence is required on the colorant-receiving layer to reconstruct the original image.

Similarly, a thermal transfer proof can be generated by using a thermal head in place of a diode laser as described in U.S. Pat. No. 4,923,846. Commonly available thermal heads are not capable of generating halftone images of adequate resolution but can produce high quality continuous tone proof images which are satisfactory in many instances. U.S. Pat. No. 4,923,846 also discloses the choice of mixtures of colorants for use in thermal imaging proofing systems. The colorants are selected on the basis of values for hue error and turbidity. The Graphic Arts Technical Foundation Research Report No. 38, "Color Material" (58-(5) 293–301, 1985) gives an account of this method.

Infrared-absorbing colorants are used in colorant-donor elements for laser-colorant transfer for the purpose of absorbing the laser energy and converting the radiant energy into thermal energy in order to cause colorant transfer to a receiver element. One problem encountered in the use of infrared colorants is that these colorants often exhibit some absorption in the visible spectrum. In the event that some or all of the infrared colorant is transferred along with the colorant, this absorption may spoil the color purity or hue of the transferred image colorant.

DESCRIPTION OF RELATED ART

U.S. Pat. No. 4,942,141 relates to certain squarylium laser-absorbing dyes for a laser-induced thermal material transfer system. While these dyes are useful for the intended purposed, there is a need for additional laser-absorbing materials with narrow absorption bands at other, selected wavelengths and exhibiting different solvent and film compatibilities.

U.S. Pat. No. 5,667,860 discloses the use of polymeric cyanine dyes for reduced bubble formation in optical recording elements. However, this patent relates to optical memory devices and not to thermal transfer imaging systems.

It is an object of this invention to provide a colorant-donor element for laser-induced thermal colorant transfer which effectively converts laser excitation to heat and which exhibits better film forming characteristics and less color contamination from absorber materials than those of the prior art.

SUMMARY OF THE INVENTION

This and other objects are achieved in accordance with this invention which relates to a colorant-donor element for thermal colorant transfer comprising a support having thereon a colorant layer having a laser radiation-absorbing material associated therewith, and wherein the laser radiation-absorbing material comprises an ionic polymer having a certain charge having associated therewith an ionic dye of opposite charge, the ionic dye comprising a laser radiation-absorbing chromophore comprising an organic moiety having a plurality of conjugated double bonds and an optical absorption of from about 400 to about 1200 nm.

DESCRIPTION OF THE PREFERRED EMBODIMENTS

In a preferred embodiment of the invention, the ionic polymer contains within its repeating units the following formula:

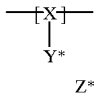

wherein:

X is a repeating unit of the ionic polymer backbone, such as a substituted or unsubstituted vinyl, acrylate, styrene, polyester, polyether, polycarbonate, polyamide, polyimide or polyurethane group;

Y is a pendant group having a certain charge, such as a carboxylate, sulfonate, sulfinate, iminodisulfonyl, phosphonium, ammonium, sulfonium, phosphonate, phosphate, or borate group;

Z is the laser radiation-absorbing chromophore having a charge opposite to said Y; and

* represents either a negative or positive charge.

In another preferred embodiment of the invention, the ionic polymer contains within its repeating units the following formula:

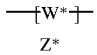

wherein:

W is a repeating unit of the ionic polymer backbone having a certain charge, such as an iminodisulfonyl, phosphonium, ammonium, sulfonium, phosphonate, phosphate, or borate group;

Z is the laser radiation-absorbing chromophore having a charge opposite to said W; and

* represents either a negative or positive charge.

In another preferred embodiment of the invention, X is a polyester, Y is a sulfonate. In yet another preferred embodiment, W is an iminodisulfonyl group.

Examples of Z useful in the invention include the following:

Z-1

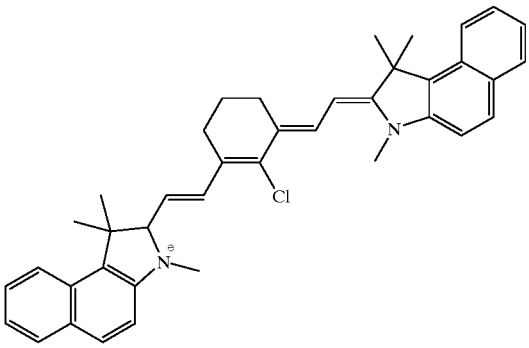

Z-2

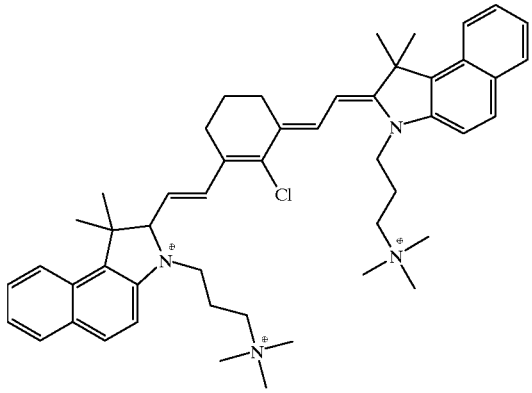

Z-3

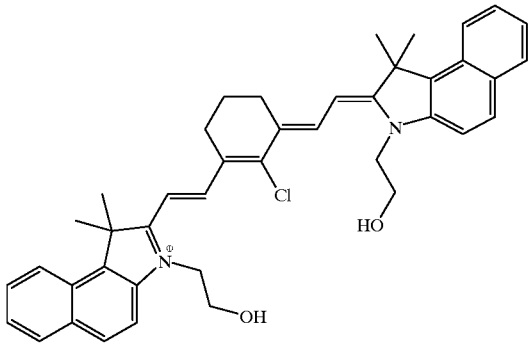

Z-4

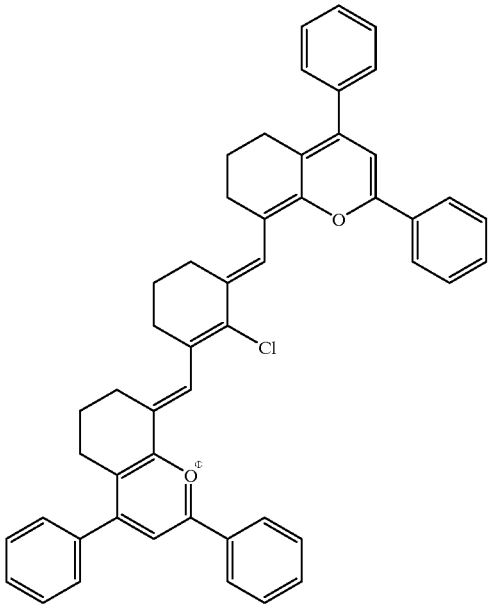

Z-5
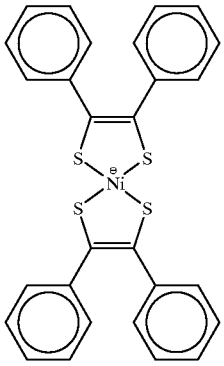
Examples of laser-absorbing polymers useful in the invention include the following:
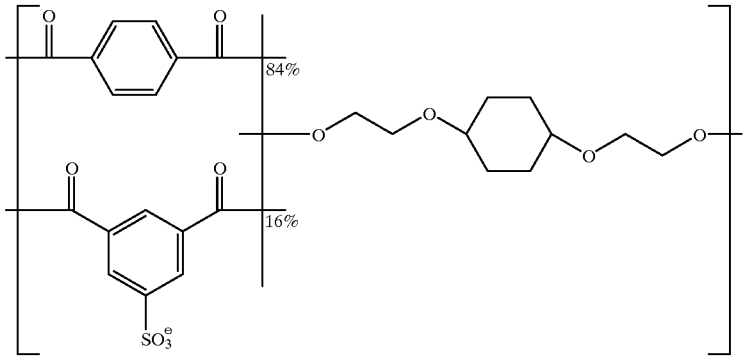
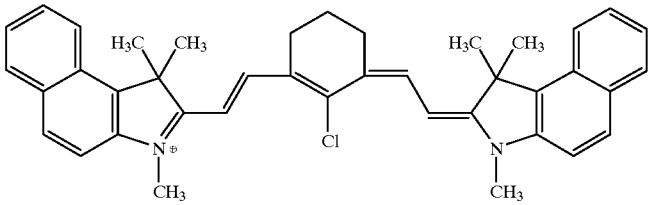
Polyester PE1

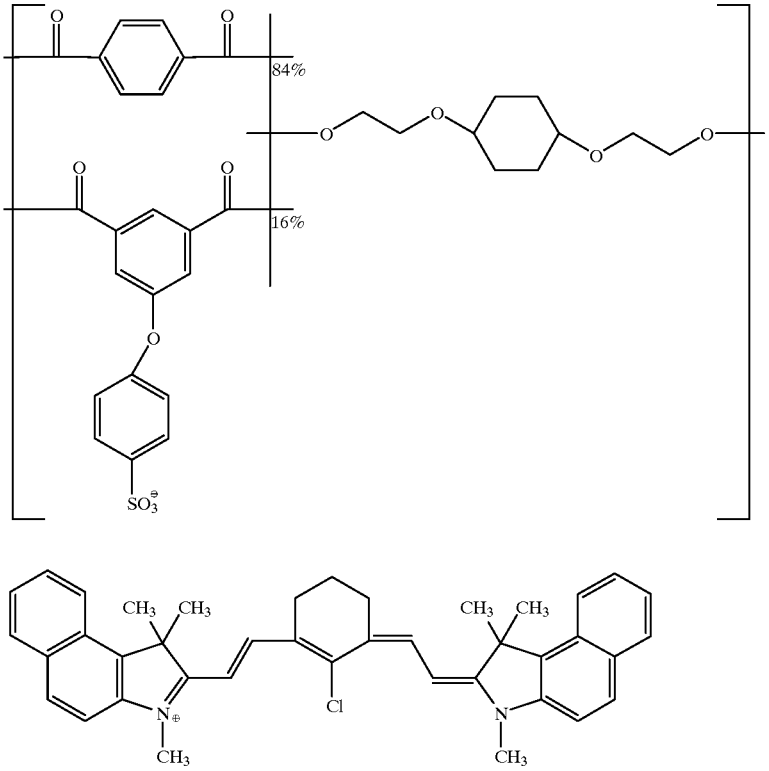
Polyester PE2
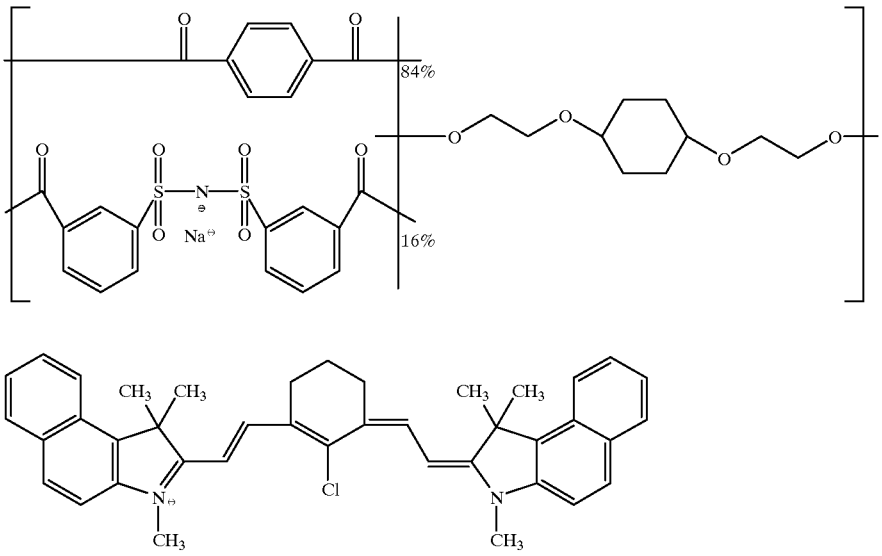
Polyester PE3

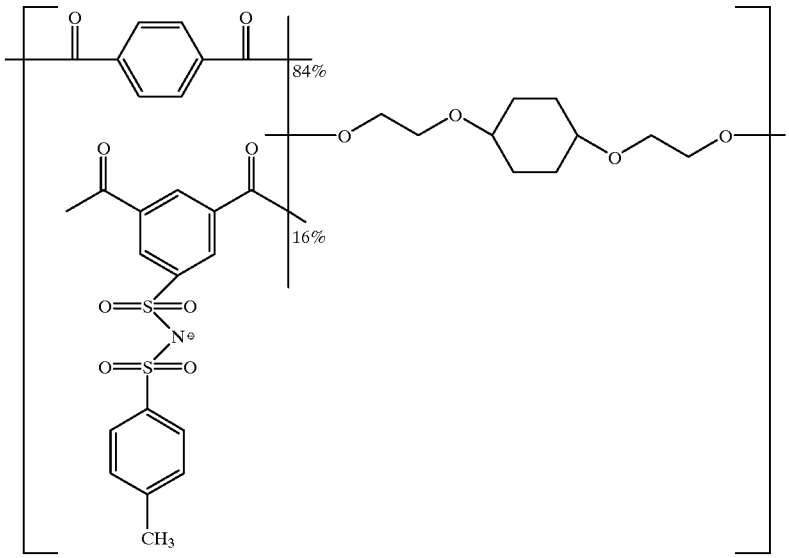
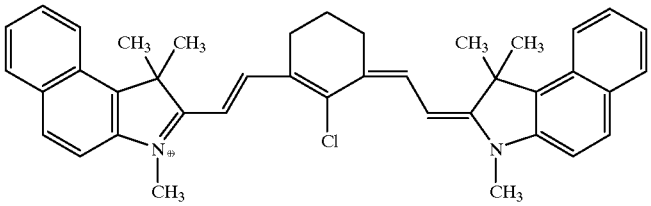
Polyester PE4
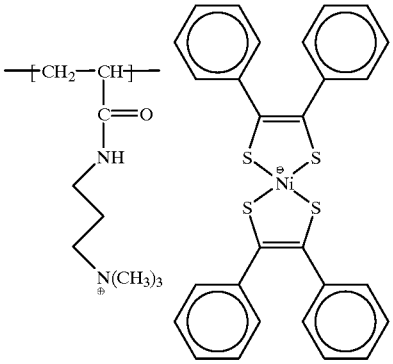
Polyvinyl PV1
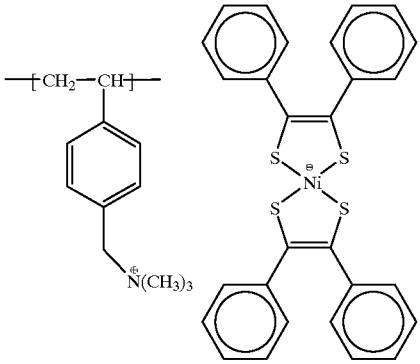
Polyvinyl PV2

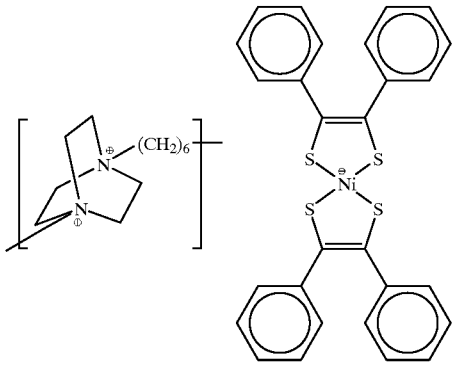

Polyammonium PA

The syntheses of several of these polymers are described in the examples hereafter.

The above-described laser radiation-absorbing polymer preferably possesses a molecular weight between about 1000 and 500,000 g/mol, and, more preferably, a molecular weight between about 2000 and 50,000 g/mol.

The above-described laser-absorbing polymer may be employed in any concentration which is effective for the intended purpose. In general, good results have been obtained at a concentration from about 0.05 to about 0.5 $g/m^2$ within the colorant layer itself or in an adjacent layer. In a preferred embodiment, the laser radiation-absorbing polymer is located in the colorant layer along with the image dye or pigment, which is a dye or pigment different from the laser radiation-absorbing chromophore.

The donor elements may optionally contain between the image colorant or pigment bearing layer and the support a sub or barrier sub such as those disclosed in U.S. Pat. Nos. 4,695,288 and 4,737,486 and may include layers formed from organo-titanates, silicates, or aluminates, and the like. Preferably, a layer formed from tetrabutyltitanate is used, available commercially as Tyzor TBT® (DuPont Corp.).

Colorants useful in the invention include both pigments and dyes. Pigments which can be used in the invention include the following: organic pigments such as metal phthalocyanines, e.g., copper phthalocyanine, quinacridones, epindolidiones, Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monstral® Blue G (C.I. No. Pigment Blue 15); Monstral® Blue BT 383D (C.I. No. Pigment Blue 15); Monstral® Blue G BT 284D (C.I. No. Pigment Blue 15); Monstral® Green GT 751D (C.I. No. Pigment Green 7) or any of the materials disclosed in U.S. Pat. Nos. 5,171,650, 5,672,458 or 5,516,622, the disclosures of which are hereby incorporated by reference.

Dyes useful in the invention include the following: Anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM®. and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine SR® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. The above dyes may be employed singly or in combination. Combinations of pigments and/or dyes can also be used.

The colorants used in the invention may be employed at a coverage of from about 0.02 to about 2 $g/m^2$.

The process of obtaining an image with the colorant-donor elements of this invention has been described in U.S. Pat. No. 5,126,760 and is conveniently obtained on commercially-available laser thermal proofing systems such as the Kodak Approval® system, or the Creo Trendsetter® Spectrum system. Typically, a receiver sheet is placed on a rotating drum followed by successive placements of the individual cyan, magenta, yellow and black donor elements whereby the image for each color is transferred by image-wise exposure of the laser beam through the backside of the donor element.

The colorants in the colorant-donor of the invention can optionally be dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; polyvinyl butyrate; copolymers of maleic anhydride with vinyl ethers such as methyl vinyl ether; polycyanoacrylates; a polycarbonate; poly(vinyl acetate); poly(styrene-co-acrylonitrile); a polysulfone or a poly(phenylene oxide). The binder may be used at a coverage of from about 0.1 to about 5 $g/m^2$.

The colorant layer of the colorant-donor element may be coated on the support or printed thereon by a printing technique such as a gravure process.

Any material can be used as the support for the colorant-donor element of the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 $\mu$m.

The receiving element that is used with the colorant-donor element of the invention usually comprises a support having thereon a colorant image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the colorant-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The image-receiving layer may comprise, for example, a polycarbonate, a polyurethane, a polyester, poly(vinyl chloride), poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or mixtures thereof. The image-receiving layer may be present in any amount which is effective for the intended purpose. In general, good results have been obtained at a coverage of from about 1 to about 5 $g/m^2$.

As noted above, the colorant-donor elements of the invention are used to form a colorant transfer image. Such a process comprises imagewise-heating a colorant-donor element as described above and transferring a colorant image to a receiving element to form the colorant transfer image.

The colorant-donor element of the invention may be used in sheet form or in a continuous roll or ribbon. If a continuous roll or ribbon is employed, it may have only the colorants thereon as described above or may have alternating areas of other different colorants or pigments or combinations, such as sublimable cyan and/or yellow and/or black dyes or other colorants. Such colorants are disclosed in U.S. Pat. No. 4,541,830, the disclosure of which is hereby incorporated by reference. Thus, one-, two-, three- or four-color elements (or higher numbers also) are included within the scope of the invention.

A laser is used to transfer colorant from the colorant-donor elements of the invention. It is preferred to use a diode laser since it offers substantial advantages in terms of its small size, low cost, stability, reliability, ruggedness, and ease of modulation Lasers which can be used to transfer colorant from colorant-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in U.S. Pat. No. 5,268,708, the disclosure of which is hereby incorporated by reference.

Spacer beads may be employed in a separate layer over the colorant layer of the colorant-donor element in the above-described laser process in order to separate the donor from the receiver during colorant transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the receiver as described in U.S. Pat. No. 4,876,235, the disclosure of which is hereby incorporated by reference. The spacer beads may be coated with a polymeric binder if desired.

The use of an intermediate receiver with subsequent retransfer to a second receiving element may also be employed in the invention as described in U.S. Pat. No. 5,126,760. A multitude of different substrates can be used to prepare the color proof (the second receiver) which is preferably the same substrate as that used for the printing press run. Thus, this one intermediate receiver can be optimized for efficient colorant uptake without colorant-smearing or crystallization.

Optionally, the paper may be pre-laminated or pre-coated with an image receiving or colorant barrier layer in a dual-laminate process such as that described in U.S. Pat. No. 5,053,381. In addition, the receiver sheet may be an actual paper proofing stock or a simulation thereof with an optional laminate overcoat to protect the final image.

Examples of substrates which may be used for the second receiving element (color proof) include the following: Flo Kote Cover® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Consolith Gloss® (Consolidated Papers Co.), Ad-Proof Paper® (Appleton Papers, Inc.) and Mountie Matte® (Potlatch Inc.).

As noted above, after the colorant image is obtained on a first colorant-receiving element, it may be retransferred to a second colorant image-receiving element. This can be accomplished, for example, by passing the two receivers between a pair of heated rollers. Other methods of retransferring the colorant image could also be used such as using a heated platen, use of pressure and heat, external heating, etc.

Also as noted above, in making a color proof, a set of electrical signals is generated which is representative of the shape and color of an original image. This can be done, for example, by scanning an original image, filtering the image to separate it into the desired additive primary colors, i.e., red, blue and green, and then converting the light energy into electrical energy. The electrical signals are then modified by computer to form the color separation data which are used to form a halftone color proof. Instead of scanning an original object to obtain the electrical signals, the signals may also be generated by computer. This process is described more fully in *Graphic Arts Manual,* Janet Field ed., Arno Press, New York 1980 (p. 358ff), the disclosure of which is hereby incorporated by reference.

A thermal colorant transfer assemblage of the invention comprises a) a colorant-donor element as described above, and b) a colorant-receiving element as described above, the colorant-receiving element being in a superposed relationship with the colorant-donor element so that the colorant layer of the donor element is in contact with the colorant image-receiving layer of the receiving element.

The above assemblage comprising these two elements may be preassembled as an integral unit when a monochrome image is to be obtained. This may be done by temporarily adhering the two elements together at their margins. After transfer, the colorant-receiving element is then peeled apart to reveal the colorant transfer image.

When a three-color image is to be obtained, the above assemblage is formed three times using different colorant-donor elements. After the first colorant is transferred, the elements are peeled apart. A second colorant-donor element (or another area of the donor element with a different colorant area) is then brought in register with the colorant-receiving element and the process repeated. The third color is obtained in the same manner. A four color image may also be obtained using the colorant-donor element of the invention.

The following examples are provided to illustrate the invention.

EXAMPLES

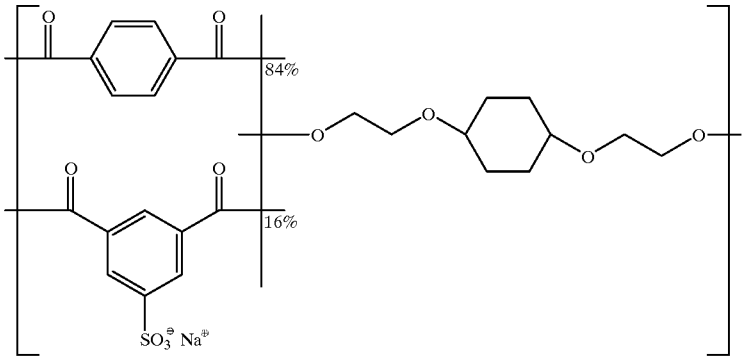

Polyesterionomer

The synthesis of the Polyesterionomer is found in U.S. Pat. No. 4,609,606.

Synthesis of Polyester PE1

With efficient stirring, 10 g (0.057 mol) of the Polyesterionomer was dissolved in 130 mL of methylene chloride. With the aid of magnetic stirring, 3.47 g (0.0046 mol) of IR1 was dissolved in 65 mL of methylene chloride. The two methylene chloride solutions were mixed together, and rolled overnight. The precipitated sodium tosylate was filtered off, and the PE1 was precipitated into methanol. The PE1 was redissolved in methylene chloride, and precipitated in cyclohexane. A stringy green solid was obtained. A film of PE1 on quartz exhibited an absorbance maximum at 840 nm.

The following materials were used in the Examples:

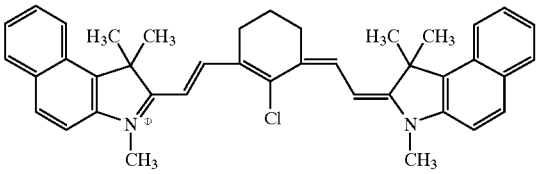

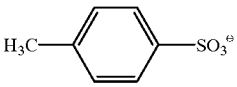

IR1

(Conventional Cyanine Laser-Absorber Dye)

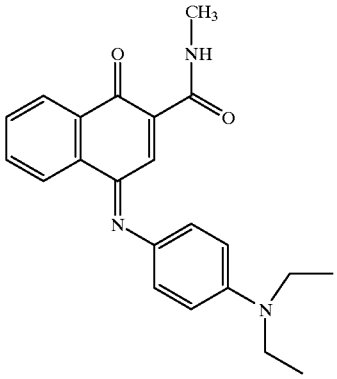

Cyan Image Dye

Example 1

Control C-1: Cyan donor element with conventional IR absorber dye

A cyan colorant-donor control element was prepared by coating a 100 $\mu$m thick poly(ethylene terephthalate) support with a solution containing 0.095 g of the Cyan Image Dye illustrated above, 0.019 g of the conventional Cyanine Laser-Absorbing Dye (IR1) as illustrated above, 0.095 g of cellulose acetate propionate binder (2.5% acetyl, 45% propionyl) in 14.79 g of methylene chloride using a 25 $\mu$m knife blade.

Element E-1: Cyan donor element of the invention.

This element was prepared the same as Control C-1 except using PE1 instead of IR1 and in an amount of 0.048 g of PE1 in order to match the infrared optical densities of the two samples.

The above elements were then exposed to a focused diode laser beam at 830 nm wavelength on an apparatus similar to that described in U.S. Pat. No. 5,446,477. A Kodak Approval® Intermediate Receiver sheet Catalogue No. 831 5582, as described in U.S. Pat. Nos. 5,053,381 and 5,342,821, was mounted on the drum on an aluminum carrier plate, and the test donor sheet placed over the intermediate sheet with the coated side facing the Intermediate Receiver sheet. The prints were finished after imaging by laminating, in a Kodak Approval® Laminator, the imaged Intermediates to sheets of Champion 60-lb. Textweb® paper which were initially pre-laminated with Kodak Prelaminate sheets, Catalogue No. 173 9671, as described in U.S. Pat. Nos. 5,053,381 and 5,342,821, in the same laminator.

Colorimetric reflection measurements were made using an X-Rite Model 938 Spectrodensitometer. The results for the donors having matched transfer sensitivity are summarized in Table 1. The results are given as Status T Red (wanted) and Status T Blue (unwanted) reflection density as a function of exposure.

TABLE 1

Color Purity for Cyan Transfer

| | Control C-1 | | | Element E-1 | | |
|---|---|---|---|---|---|---|
| Exposure (mJ/cm$^2$) | Red Density[1] | Blue Density[1] | Color Purity[2] | Red Density[1] | Blue Density[1] | Color Purity[2] |
| 643 | 1.37 | 0.34 | 4.03 | 1.63 | 0.31 | 5.26 |
| 583 | 1.42 | 0.36 | 3.94 | 1.56 | 0.31 | 5.03 |
| 523 | 1.41 | 0.37 | 3.81 | 1.55 | 0.31 | 5.00 |
| 463 | 1.42 | 0.38 | 3.74 | 1.48 | 0.25 | 5.92 |
| 403 | 1.41 | 0.36 | 3.92 | 1.25 | 0.16 | 7.81 |
| 343 | 1.09 | 0.17 | 6.41 | 0.85 | 0.08 | 10.63 |
| 283 | 1.72 | 0.09 | 8.00 | 0.28 | 0.02 | 14.00 |

[1]Status T density transferred minus the paper density
[2]Ratio of red/blue density The above results show that for a given exposure, Element E-1 of the invention had a higher ratio of wanted red density to unwanted blue density as compared to the control element. Thus, the purity of the transferred cyan color of the element of the invention is superior to the control element.

The invention has been described in detail with particular reference to preferred embodiments thereof, but it will be understood that variations and modifications can be effected within the spirit and scope of the invention.

What is claimed is:

1. A colorant-donor element for thermal colorant transfer comprising a support having thereon a colorant layer having a laser radiation-absorbing material associated therewith, and wherein said laser radiation-absorbing material comprises an ionic polymer having a certain charge having associated therewith an ionic dye of opposite charge, said ionic dye comprising a laser radiation-absorbing chromophore comprising an organic moiety having a plurality of conjugated double bonds and an optical absorption of from about 400 to about 1200 nm.

2. The element of claim 1 wherein said ionic polymer contains within its repeating units the following formula:

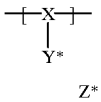

wherein:

X is a repeating unit of said ionic polymer backbone;

Y is a pendant group having a certain charge;

Z is said laser radiation-absorbing chromophore having a charge opposite to said Y; and

* represents either a negative or positive charge.

3. The element of claim 2 wherein X is a substituted or unsubstituted vinyl, acrylate, styrene, polyester, polyether, polycarbonate, polyamide, polyimide or polyurethane group and Y is a carboxylate, sulfonate, sulfinate, iminodisulfonyl, phosphonium, ammonium, sulfonium, phosphonate, phosphate, or borate group.

4. The element of claim 2 wherein X is a polyester, Y is a sulfonate, and Z is

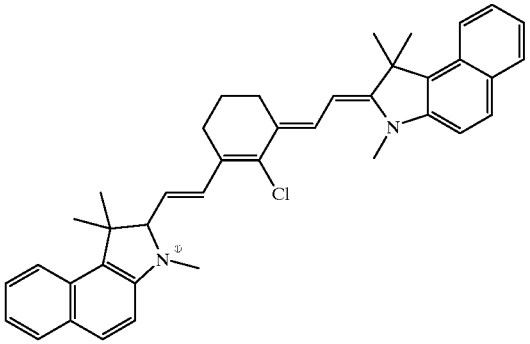

5. The element of claim 1 wherein said ionic polymer contains within its repeating units the following formula:

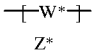

wherein:

W is a repeating unit of said ionic polymer backbone having a certain charge;

Z is said laser radiation-absorbing chromophore having a charge opposite to said W; and

* represents either a negative or positive charge.

6. The element of claim 5 wherein W is an iminodisulfonyl, phosphonium, ammonium, sulfonium, phosphonate, phosphate, or borate group.

7. The element of claim 5 wherein W is an iminodisulfonyl group and Z is

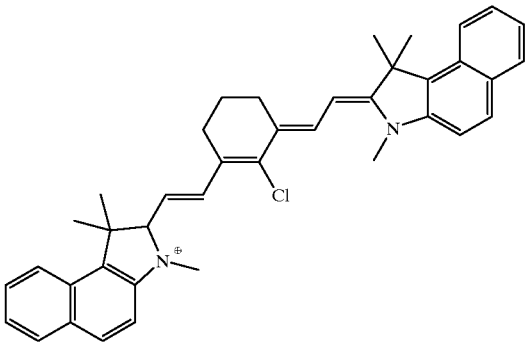

8. The element of claim 1 wherein said colorant layer contains said laser radiation-absorbing material.

9. A process of forming a colorant transfer image comprising imagewise-heating a colorant-donor element comprising a support having thereon a colorant layer having a laser radiation-absorbing material associated therewith and transferring a colorant image to a colorant-receiving element to form said colorant transfer image, and wherein said laser radiation-absorbing material comprises an ionic polymer having a certain charge having associated therewith an ionic dye of opposite charge, said ionic dye comprising a laser radiation-absorbing chromophore comprising an organic moiety having a plurality of conjugated double bonds and an optical absorption of from about 400 to about 1200 nm.

10. The process of claim 9 wherein said ionic polymer contains within its repeating units the following formula:

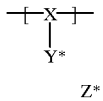

wherein:

X is a repeating unit of said ionic polymer backbone;

Y is a pendant group having a certain charge;

Z is said laser radiation-absorbing chromophore having a charge opposite to said Y; and

* represents either a negative or positive charge.

11. The process of claim 10 wherein X is a substituted or unsubstituted vinyl, acrylate, styrene, polyester, polyether, polycarbonate, polyamide, polyimide or polyurethane group and Y is a carboxylate, sulfonate, sulfinate, iminodisulfonyl, phosphonium, ammonium, sulfonium, phosphonate, phosphate, or borate group.

12. The process of claim 10 wherein X is a polyester, Y is a sulfonate, and Z is

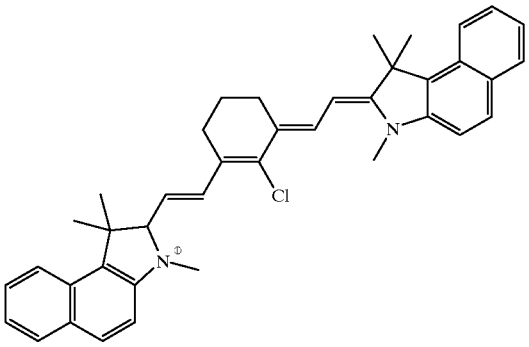

13. The process of claim 9 wherein said ionic polymer contains within its repeating units the following formula:

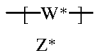

wherein:

W is a repeating unit of said ionic polymer backbone having a certain charge;

Z is said laser radiation-absorbing chromophore having a charge opposite to said W; and

* represents either a negative or positive charge.

14. The process of claim 13 wherein W is an iminodisulfonyl, phosphonium, ammonium, sulfonium, phosphonate, phosphate, or borate group.

15. A thermal colorant transfer assemblage comprising:

a) a colorant-donor element comprising a support having thereon a colorant layer having a laser radiation-absorbing material associated therewith, and b) a colorant-receiving element comprising a support having thereon a colorant image-receiving layer, said colorant-receiving element being in a superposed relationship with said colorant-donor element so that said colorant layer is in contact with said colorant image-receiving layer, and wherein said laser radiation-absorbing material comprises an ionic polymer having a certain charge having associated therewith an ionic dye of opposite charge, said ionic dye comprising a laser radiation-absorbing chromophore comprising an organic moiety having a plurality of conjugated double bonds and an optical absorption of from about 400 to about 1200 nm.

16. The assemblage of claim 15 wherein said ionic polymer contains within its repeating units the following formula:

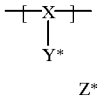

wherein:

X is a repeating unit of said ionic polymer backbone;

Y is a pendant group having a certain charge;

Z is said laser radiation-absorbing chromophore having a charge opposite to said Y; and

* represents either a negative or positive charge.

17. The assemblage of claim 16 wherein X is a substituted or unsubstituted vinyl, acrylate, styrene, polyester, polyether, polycarbonate, polyamide, polyimide or polyurethane group and Y is a carboxylate, sulfonate, sulfinate, iminodisulfonyl, phosphonium, ammonium, sulfonium, phosphonate, phosphate, or borate group.

18. The assemblage of claim 16 wherein X is a polyester, Y is a sulfonate, and Z is

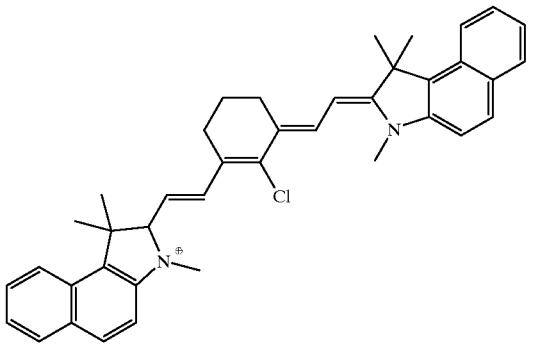

19. The assemblage of claim 15 wherein said ionic polymer contains within its repeating units the following formula:

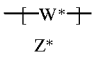

wherein:

W is a repeating unit of said ionic polymer backbone having a certain charge;

Z is said laser radiation-absorbing chromophore having a charge opposite to said W; and

* represents either a negative or positive charge.

20. The assemblage of claim 19 wherein W is an iminodisulfonyl, phosphonium, ammonium, sulfonium, phosphonate, phosphate, or borate group.

* * * * *